United States Patent [19]

Maier

[11] 4,184,442

[45] Jan. 22, 1980

[54] BLIND STITCH SEWING MACHINE

[75] Inventor: Erwin Maier, Kongen, Fed. Rep. of Germany

[73] Assignee: Wilhelm Maier & Sohne, Kongen, Fed. Rep. of Germany

[21] Appl. No.: 926,515

[22] Filed: Jul. 20, 1978

[30] Foreign Application Priority Data

Aug. 16, 1977 [DE] Fed. Rep. of Germany ..... 2736780

[51] Int. Cl.[2] ..... D05B 1/24; D05B 9/05

[52] U.S. Cl. ..... 112/178

[58] Field of Search ..... 112/178, 177, 176, 267.1, 112/284

[56] References Cited

U.S. PATENT DOCUMENTS

| | | | |
|---|---|---|---|
| 1,413,581 | 4/1922 | Hayes | 112/178 |
| 1,434,399 | 11/1922 | Moulton | 112/178 |
| 1,531,850 | 3/1925 | Dearborn | 112/178 |
| 1,588,135 | 6/1926 | Mueller | 112/178 |
| 1,622,414 | 3/1927 | Brody | 112/178 |
| 4,043,284 | 8/1977 | Rau et al. | 112/178 |

*Primary Examiner*—Werner H. Schroeder
*Assistant Examiner*—Andrew M. Falik
*Attorney, Agent, or Firm*—Thomas W. Speckman

[57] ABSTRACT

An improved blind stitch sewing machine wherein the upper end position of a reciprocating plunger element below the curved oscillating needle is not changed by slight irregularities in the feed and is automatically adjusted to an increase in thickness of the sewing material, such as seams, providing an adjustment which is maintained over the width of the thickness increase.

10 Claims, 4 Drawing Figures

BLIND STITCH SEWING MACHINE

This invention relates to a blind stitch sewing machine having a curved needle, which is placed oscillatingly in the head of the upper arm and is guided in a stitch plate, and a reciprocating plunger, which is arranged in the lower arm and whose rocking shaft can be driven oscillatingly and whose position relative to the path of the needle is automatically changeable in dependence upon the thickness of the material to be sewn.

Blind stitch sewing machines serve to sew the respective sewing material in such a way that the seam is not visible on at least the outer side of the sewn material. These blind stitch sewing machines have a curved needle and a plunger arranged in the sewing zone which lifts the sewing material so far in a perforation of the stitch plate that the curved needle does not stitch entirely through the layers of sewing material to be connected but only performs shallow stitching in the outer layer of the sewing material facing away from the needle.

In order to produce such a seam, the stitching depth of the curved needle must be adjusted automatically according to the thickness of the sewing material. The plunger must, therefore, approach the path of motion of the curved needle only up to a defined end position. Special difficulties occur if the sewing material is not uniformly thick, for example, if sewing is to be done over cross seams or other thickened areas.

Many solutions in the nature of an adjustment of the plunger stroke are already known from German patent specifications: DT-PS No. 948 735; DT-AS No. 10 12 153; DT-PS No. 10 51 101; and DT-OS No. 21 30 434. With the devices of these patent specifications on a blind stitch sewing machine, only an adjustment to the sewing materials of different thickness takes place. However, an automatic adjustment to the plunger element stroke during the sewing over an increase in thickness in the sewing material is not possible therewith.

An automatic adjustment of the plunger element when sewing over an increase in thickness in the sewing material has been achieved by the insertion of spring-loaded points in the plungers. The spring-loaded points press the sewing material against an adjustable stop of the stitch plate. These two parts can be adjusted in such a way that in case of an increase in thickness in the sewing material the tip of the plunger element is lowered downward so far, for example, pressed off, that the curved needle carries out only the desired shallow stitching motion and does not go completely through the layers of material to be sewn (German Patent Specification DT-PS No. 11 02 536). Since on these blind stitch sewing machines the small surface of the tip of the plunger element exerts an increased lowering force on the sewing material during the sewing over an increase in thickness, the proposal is not able to give full satisfaction if sewing material of different thickness and softness is sewn on the blind stich sewing machine. These spring-loaded plunger elements also have the disadvantage that, during the sewing over wide increases in thickness, the lowering of the plunger element is carried out with every stroke of the plunger element. This causes additional noise and vibrations which impair the sewing operation, especially if the entire plunger with its holder is spring-mounted. Moreover, delicate materials are easily damaged here.

As shown in German Patent Specification DT-AS No. 25 11 568, also known is a blind stitch sewing machine where, by way of a lever mechanism having a scanning roll, a reciprocating plunger element can be lowered directly in dependence of the thickness of the sewing material and its upper end position is thus changed automatically. This rigid coupling between the reciprocating plunger element and the scanning roll brings about that, even with the same thickness of the sewing material, the reciprocating plunger element changes its position continuously relative to the rocking shaft of the plunger element because of the non-uniform movement or other irregularities in the feed of the sewing material, and this impairs the sewing operation. Beyond that, even with this solution, the reciprocating plunger element must be adjusted to the manual primary setting for the sewing material to be processed.

It is an objective of this invention to provide a blind stitch sewing machine of the type referred to above in such a way that, during the sewing of uniformly thick sewing material, the upper end position of the reciprocating plunger element is not changed by slight irregularities in the feed and such and that only during the sewing over an increase in thickness in the sewing material it adjusts automatically to the increase in thickness of the sewing material in such a way that the adjustment is maintained over the entire width of the increase in thickness.

As disclosed in the description of this invention, the above problems are solved by the fact that the rocking shaft of the plunger element is coupled on its drive side end, by way of a universal joint, with a separate auxiliary shaft placed and drivable in the lower arm and is guided vertically adjustable in the lower arm on the end of the plunger element, by having below the stitch plate arranged on the lower arm a control roll which is adjustable to a specifiable distance from the stitch plate and can be lowered from this position only if the thus specified thickness of the sewing material is exceeded, and that during this lowering the control roll lowers simultaneously also the end of the rocking shaft of the plunger element on the end having the plunger element. As long as the sewing material has a thickness which can be preset by means of the full setting of the control, the upper end position of the reciprocating plunger element will not change and the reciprocating plunger element will always reach the upper end position required for the shallow stitching of this sewing material. Only if the control roll discovers a increase in thickness in the sewing material, it is lowered corresponding to this increase in thickness and also lowers the rocking shaft of the plunger element. With the drive of the reciprocating plunger element remaining the same, its upper end position is thereby lowered automatically so far that during the sewing over increase in thickness in the sewing material the shallow stich remains guaranteed. Compared to devices shown, the adjusting mechanism of this type has the advantage that the sewing operation is much more quiet and that the drive of the reciprocating plunger element can remain practically unchanged since the universal joint and the vertically adjustable bearing of the rocking shaft of the plunger element do not effect the drive with its adjusting mechanism. The coupling means between the control roll and the rocking shaft of the plunger element are also simpler than the complicated lever bars of well known blind stitch sewing machines.

According to one embodiment, the vertically adjustable bearing on the end of the rocking shaft of the plunger element on the plunger element end is designed in such a way that the end of the rocking shaft of the plunger element on the plunger element end is arranged freely rotatable in a slide ring and that the slide ring is located vertically adjustable in a slide ring fork of the lower arm.

The mounting of the rocking shaft of the plunger element with the slide ring in the lower arm is facilitated by the fact that the slide ring fork is open toward the upper side of the lower arm and is closed by means of a closing plate.

According to another embodiment, the pressing force of the reciprocating plunger element against the sewing material can be adjustable by the fact that the bottom side of the slide ring is supported, by way of a pressure ring, on a setscrew adjustable in the lower arm.

Axial play of the slide ring is avoided because the slide ring, by way of an axial setoff, bears on the slide ring fork and, on the opposite outer side, is held axially non-adjustable on the rocking shaft of the plunger element by means of a setting ring and because the bearing surfaces of the slide ring and of the slide ring fork are curved concave and convex corresponding to the oscillation radius of the rocking shaft of the plunger element.

The coupling between the control roll and the rocking shaft of the plunger element is achieved without interference in the drive mechanism of the reciprocating plunger element by simple means because the control roll is placed rotatable on the free end of a control lever, because the other end of the control lever is fixed oscillating on the lower arm and because the control lever rests on the rocking shaft of the plunger element by way of an adjustable wedge-shaped follower.

The adjustment for the given thickness of the sewing material up to which the upper end position of the reciprocating plunger element remains the same can be carried out here because of the fact that the wedge-shaped follower is attached adjustably on the lower arm vertical to the rocking shaft of the plunger element and that the control lever with the control roll can be raised or lowered by way of said wedge-shaped follower.

In order that the lowering mechanism of this type does not brake the rocking shaft of the plunger element too much, there is provided according to another embodiment that the rocking shaft of the plunger element carries in the supporting zone of the control lever and of the wedge-shaped follower a radial bearing, for instance, a roller bearing or a needle bearing.

This invention is explained in detail by means of a preferred embodiment illustrated in the drawings wherein.

Figure 1:
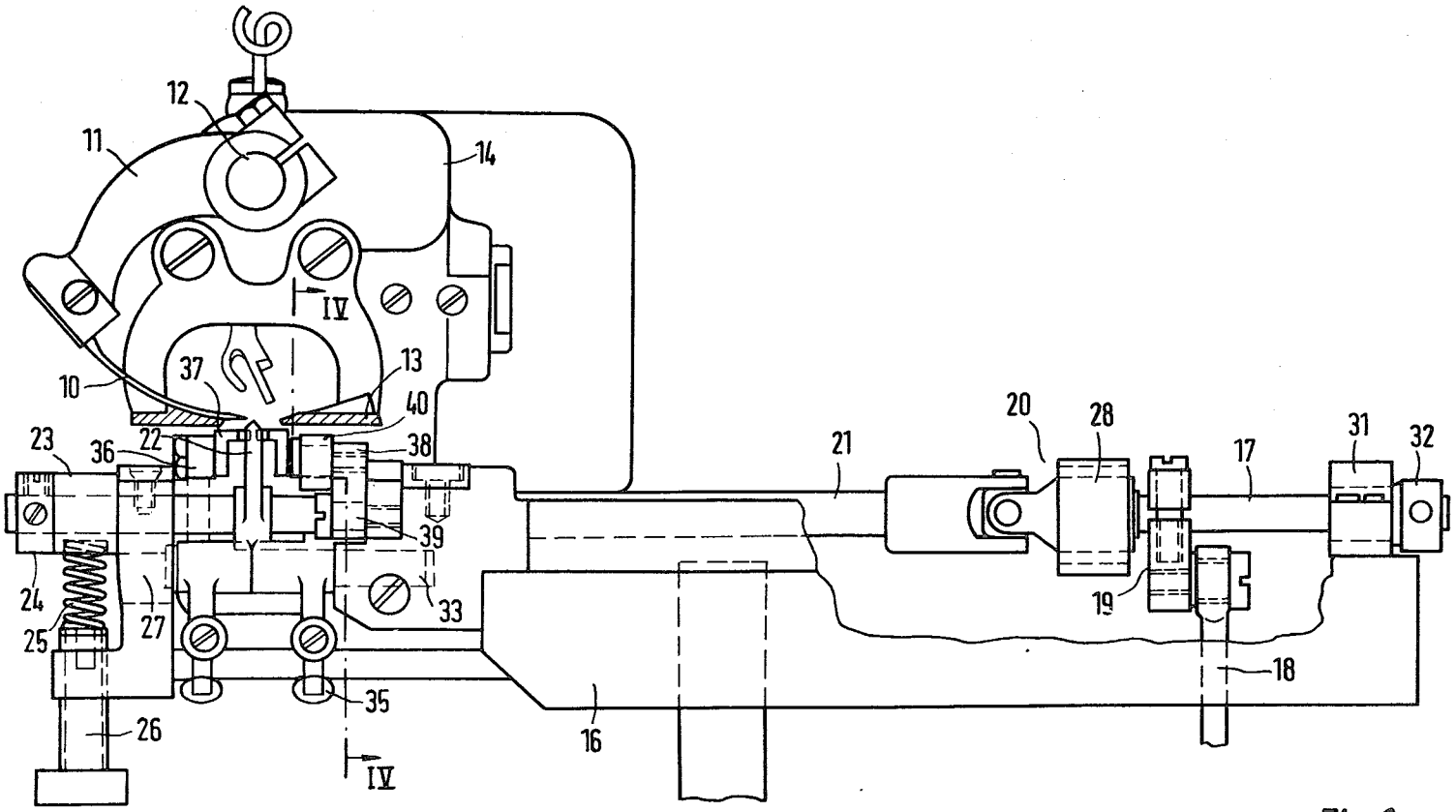
FIG. 1 is a side view of the part of a blind stitch sewing machine with the head of the upper arm and the drive of the reciprocating plunger element in the lower arm.
Figure 3:
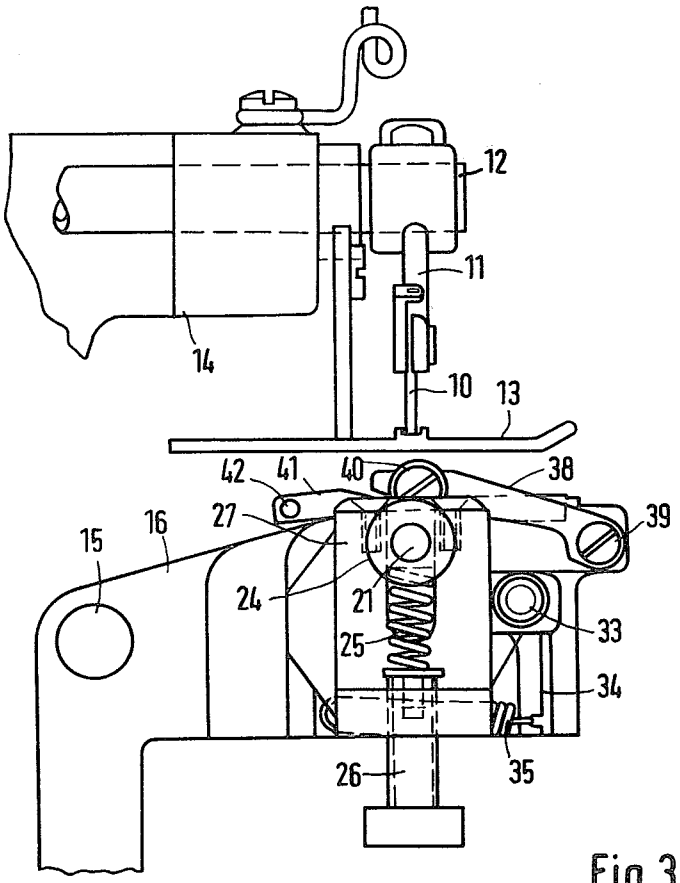
FIG. 3 is a front view of the machine shown in FIG. 1.

As can be seen in FIGS. 1 and 3, the rocking shaft of the needle is placed in the head of the upper arm 14. The protruding end carries torsion-resistant needle holder 11 with the curved needle 10 which is guided in the stitch plate 13 attached to upper arm 14.

Figure 2:
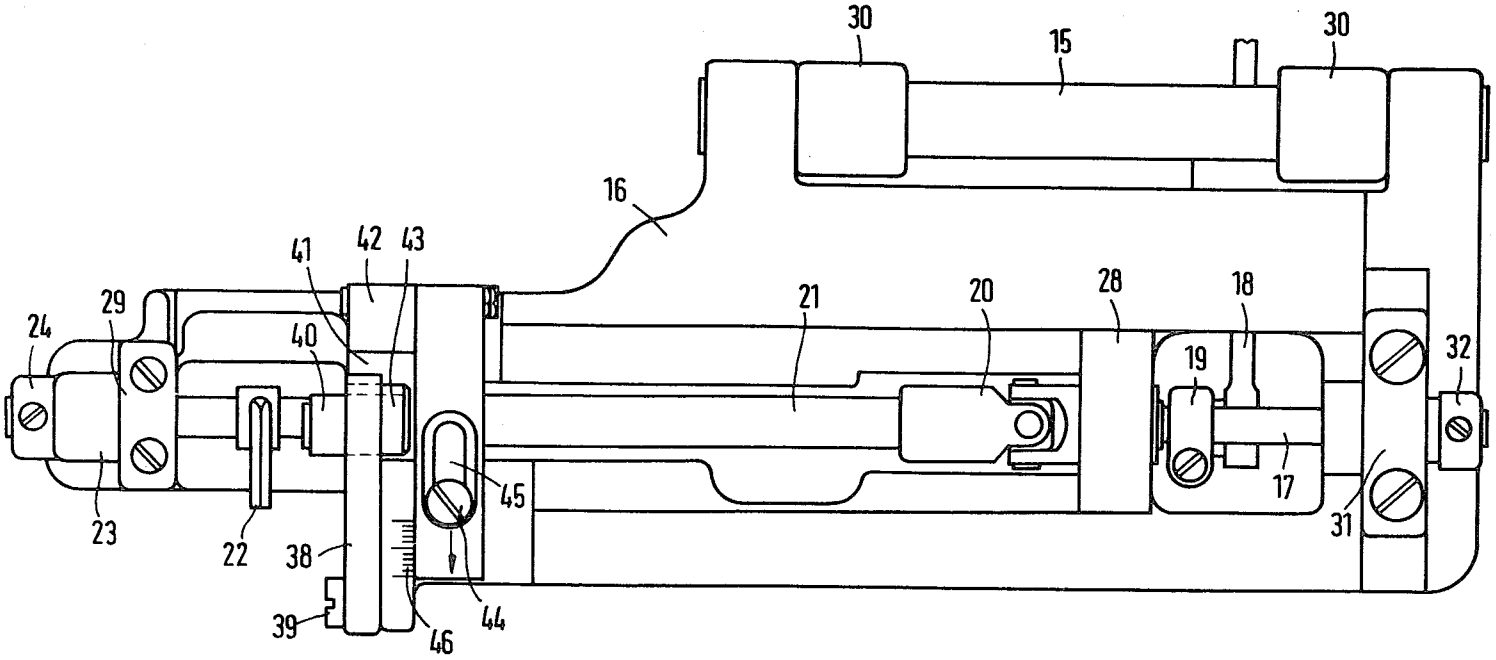
FIG. 2 is a top view of the upper side of the opened lower arm of the machine shown in FIG. 1.
Figure 4:
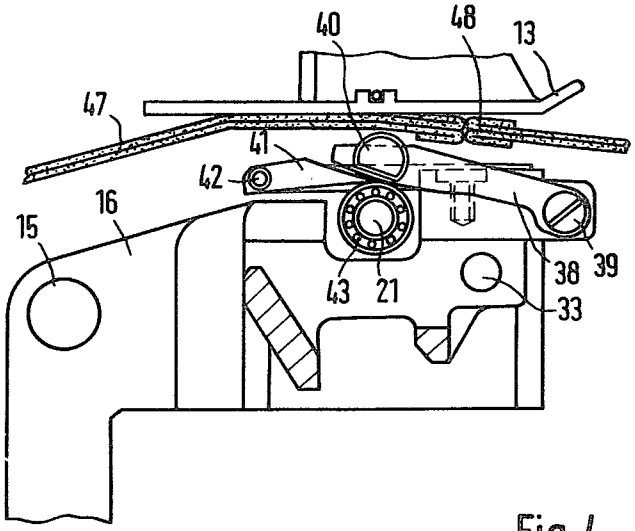
FIG. 4 is a partial section along line IV—IV of FIG. 1.

As can be seen in FIG. 2, the lower arm 16 is linked, by means of rocking axle 15, in a well known manner on firmly fixed bearing brackets 30 on the support so that the lower arm 16 can be turned down or up. The upper covering of the lower arm 16, which serves as support for the sewing material 47, is taken off in the drawings so that the parts of the plunger element drive can be seen better.

In the lower arm 16, an auxiliary shaft 17 facing away from the sewing area below the stitch plate 13 is placed in bearings 28 and 31. Outside the bearing 31, the auxiliary shaft 17 is held axially immovable by means of the setting ring 32. By way of the control lever 18 and the rocking lever 19, the auxiliary shaft 17 is put into oscillating rotary movements which are synchronized with the oscillating motion of the curved needle 10 in a well known manner. The end of the auxiliary shaft 17 protruding from the bearing 28 is coupled with the rocking shaft 21 of the plunger element by way of a universal joint 20. On this rocking shaft 21 of the plunger element, the reciprocating plunger element 22 is fastened torsion-resistant, namely, directly below the perforation in the stitch plate. The end of the rocking shaft 21 of the plunger element at the plunger element end holds freely rotatable a slide ring 23 which is vertically adjustable in a slide ring fork 27, open toward the top, of the lower arm 16. Slide ring fork 27 is closed by means of the closing plate 29 which simultaneously limits also the upward adjustment of the slide ring 23. As the side view according to FIG. 1 shows, outside the slide ring fork 27 the slide ring 23 goes over into a setoff which jointly with the setting ring 24 takes care of the axial fixation of the slide ring 23. This setoff of the slide ring 23 is curved concave in this zone corresponding to the possible oscillating motion of the rocking shaft 21 of the plunger element while the facing bearing surface of the slide ring fork 27 is curved correspondingly convex. The bottom side of slide ring 23 is supported, by way of the pressure spring 25, on a setscrew 26 adjustable in the lower arm 16. By means of said setscrew 26, the pressing force of the reciprocating plunger 22 against the sewing material 47 can be adjusted. With this support, the end of the rocking shaft 21 of the plunger on the plunger element end can be lowered vertically to a certain extent; whereby the reciprocating plunger 22 is lowered simultaneously without a noteworthy change of its axial position, that is, its position relative to the performation in the stitch plate 13. The universal joint 20 allows this lowering motion in any rotary position of the rocking shaft of the plunger element without impairing its reciprocating motion thereby.

The press plate 37 for the material is suspended on levers 36. Levers 36 are placed in the lower arm by way of the bearing shaft 33; here tension spring 35, which press the presses plate 37 for the material elastically against the lower side of the stitch plate 13, acts on the extensions 34 of levers 36.

The lowering motion of the rocking shaft 21 of the plunger element is controlled by way of a control roller 40 which is placed rotatable on the free end of a control lever 38. As the bearing screw 39 shows, the other end of the control lever 38 is fixed on the lower arm so that it can oscillate.

On the lower arm 16, a wedge shaped follower 41 is also adjustable vertically to the rocking shaft 21 of the plunger element by way of the bearing pin 42 and can be pushed in more or less between the control lever 38 and the roller bearing 43 put on the rocker shaft 21 of the plunger element in this zone. By way of the wedge shaped follower 41, the control roller 40 can therefore be adjusted to a specified distance from the bottom side of the stitch plate 13. As FIG. 2 shows, the follower 41 can be adjusted in a setting slot 45 of the lower arm 16 by way of a set and stop screw 44 of a setting plate on which the follower 41 is linked by way of the bearing pin 42; here the relative distance of the control roller 40 from the stitch plate 13 can be read on a setting scale 46.

As long as during the sewing operation the sewing material 47 does not exceed the thickness predetermined by the distance between the control roller 40 and the stitch plate 13, the lowering mechanism does not operate, not even if slight irregularities in the feed and in the thickness of the sewing material 47 occur. Only when sewing takes place over a real increase in thickness 48 in the sewing material 47, the control roller 40 is lowered correspondingly and thereby takes along the rocking shaft 21 of the plunger element by way of follower 41. The lowering motion of the control roller 40 and of the rocking shaft 21 of the plunger element is maintained here until the increase in thickness 48 has passed the needle zone. For this reason, the axis of rotation of the roller 40 is practically also in one plane with the path of motion of the curved needle 10. The lowering motion of the control roller 40 corresponds approximately to the lowering motion of the rocking shaft 21 of the plunger since the longitudinal axis of said shaft is arranged also approximately in the plane of the path of motion of the curved needle.

By means of this lowering mechanism there is thus established a threshold in the thickness of the sewing material below which the upper end position of the reciprocating plunger is not changed. However, the manual adjustment of the upper end position can be retained unchanged. If this threshold in the thickness of the sewing material is exceeded, the rocking shaft of the plunger is lowered by the degree that corresponds approximately to the degree by which this specified thickness of the sewing material is exceeded.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a blind stitch sewing machine having a curved needle, which is placed in the oscillating head of an upper arm (14) and is guided in a stitch plate (13), and a reciprocating plunger element (22), which is arranged in a lower arm (16) and having a rocking shaft (21) driven oscillatingly and whose position relative to the path of the needle is automatically changeable in dependence upon the thickness of the material to be sewn, the improvement comprising; said rocking shaft (21) of the plunger being coupled on its drive side end, by way of a universal joint (20), with a separate auxiliary shaft (17) placed and drivable in said lower arm (16) and is guided to be vertically adjustable in said lower arm (16) at the end on the plunger side, and below said stitch plate (13) there is arranged on said lower arm (16) a control roller (40) which is adjustable to a specifiable distance from said stitch plate (13) and can be lowered from this position only if the thus specified thickness of the sewing material is exceeded, and that during this lowering said control roller (40) lowers simultaneously also the end of said rocking shaft (21) of said plunger (22) on said plunger element end.

2. The blind stitch sewing machine as defined in claim 1 characterized by the end of said rocking shaft (21) of the plunger on the plunger element end being placed freely rotatable in a slide ring (23) and that said slide ring (23) is guided vertically adjustable in a slide ring fork (27) of said lower arm (16).

3. The blind stitch sewing machine as defined in claim 1, characterized by said control roller (40) being place rotatable on the free end of a control lever (38), that the other end of the control lever is fixed on the lower arm (16) so that it may rotate and that the control lever (38) is supported on the rocking shaft (21) of the reciprocating plunger element by way of an adjustable wedge-shaped follower (41).

4. The blind stitch sewing machine as defined in claim 1, characterized by the axis of rotation of said control roller (40) being arranged approximately in the vertical plane given by the path of motion of said curved needle (10).

5. The blind stitch sewing machine as defined in claim 1, characterized by the longitudinal axis of said rocking shaft (21) of said plunger being arranged approximately in the vertical plane given by the path of motion of said curved needle (10).

6. The blind stitch sewing machine as defined in claim 2, characterized by the slide ring fork (27) being open toward the top side of the lower arm (16) and is closed by means of a closing plate (29).

7. The blind stitch sewing machine as defined in claim 2, characterized by the bottom side of said slide ring (23) being supported on a setscrew (26) adjustable in said lower arm (16) by way of a pressure spring (25).

8. The blind stitch sewing machine as defined in claim 2, characterized by said slide ring (23) by way of an axial setoff bears on the slide ring fork (27) and on the opposite outer side being held axially non-adjustable on said rocking shaft (21) of the plunger element by means of a setting ring (24) and that the bearing surfaces of the slide ring (23) and of the slide ring fork (27) are curved concave and convex corresponding to the radius of oscillation of the rocking shaft (21) of the plunger.

9. The blind stitch sewing machine as defined in claim 3, characterized by said wedge-shaped follower (41) being attached adjustably on the lower arm (16) vertical to the rocking shaft (21) of said plunger and that the control lever (38) can be raised and lowered with said control roller (40) by way of said follower (41).

10. The blind stitch sewing machine as defined in claim 3, characterized by said rocking shaft (21) of said plunger carrying a radial bearing (43) in the support zone of the control lever (38) and the wedge shaped follower (41).

* * * * *